US005102193A

United States Patent [19]

Goss et al.

[11] Patent Number: 5,102,193

[45] Date of Patent: Apr. 7, 1992

[54] LINEAR ACTUATOR CONTROL SYSTEM

[76] Inventors: Duke W. Goss, 6620 NE. 129th St., Kirkland, Wash. 98034; Kyle T. Anderson, 950 W. Sunset Way, Issaquah, Wash. 98027; Daniel H. Solomonson, 4415 N. Stevens, Tacoma, Wash. 98407

[21] Appl. No.: 366,601

[22] Filed: Jun. 14, 1989

[51] Int. Cl.[5] ..... B60N 2/02

[52] U.S. Cl. ..... 297/355; 297/361

[58] Field of Search ..... 292/355, 361, DIG. 3, 292/DIG. 10; 188/300

[56] References Cited

U.S. PATENT DOCUMENTS

| | | | |
|---|---|---|---|
| 3,236,515 | 2/1966 | Ackerman | 297/355 X |
| 3,246,868 | 4/1966 | Martens et al. | 297/361 X |
| 3,471,140 | 10/1969 | Ballard | 297/355 X |
| 3,477,550 | 11/1969 | Suzuki et al. | 297/355 X |
| 3,528,532 | 9/1970 | Moskow | 297/355 X |
| 3,963,101 | 6/1976 | Stadelmann et al. | 297/355 X |

*Primary Examiner*—Jose V. Chen

[57] ABSTRACT

A linear actuator control system (10) as applied to a chaise lounge (12) having a seat back (14) pivotally hinged to a seat portion (16). The actuator (20) includes a piston assembly (46) mounted within a cylinder assembly (48) for controlled movement through a position control assembly (50). A rotatable valve assembly (172) mounted within the piston (66) prevents the flow of hydraulic fluid through a passageway (88) in the piston to selectively lock the piston (66) in position within the cylinder (96). A cam assembly (174) translates linear movement of a cable (244) into rotational movement by the interaction of a cam follower (216) and a cam member (214) having an opening (224) formed therein that interacts with the cam follower (216).

10 Claims, 4 Drawing Sheets

Fig. 5A.
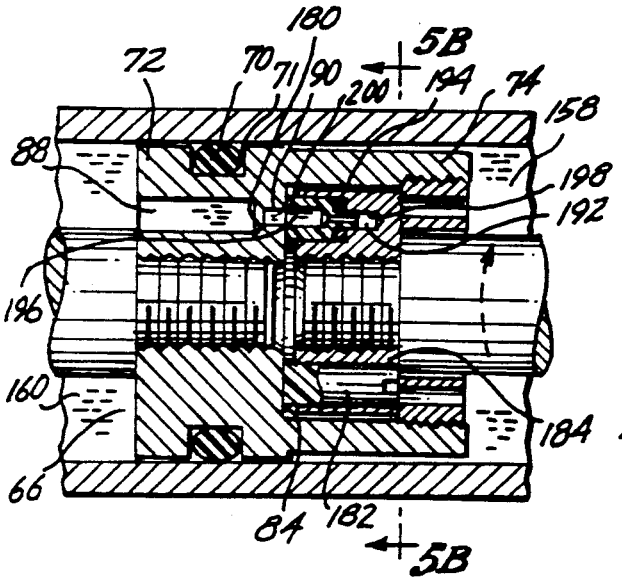
Fig. 5B.
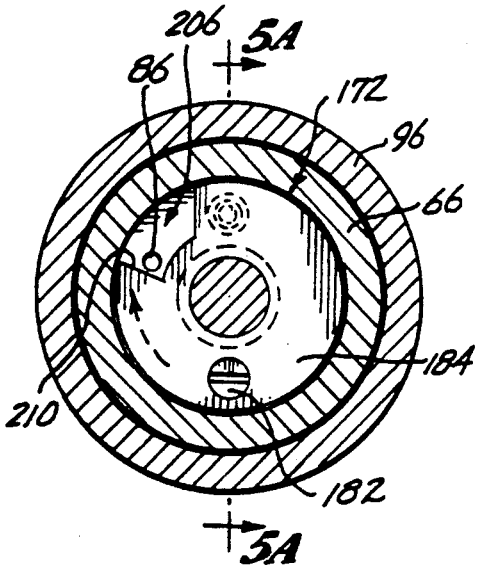
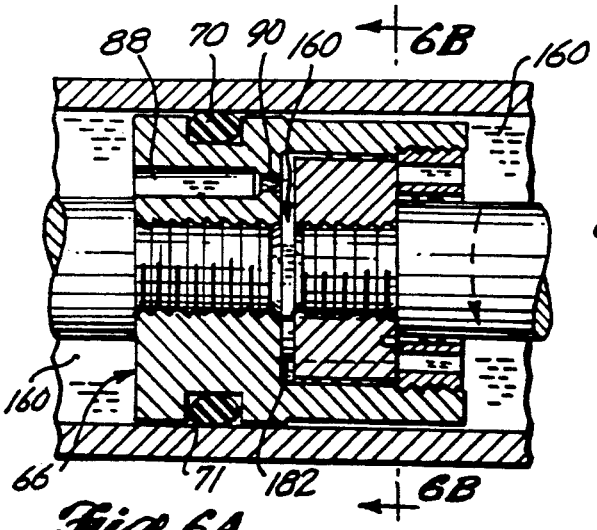
Fig. 6A.
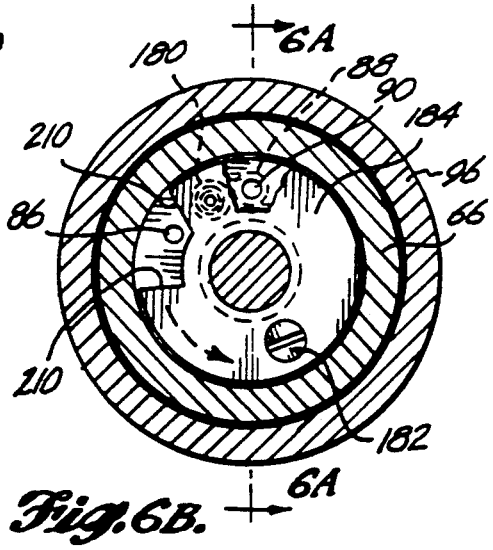
Fig. 6B.

LINEAR ACTUATOR CONTROL SYSTEM

TECHNICAL FIELD

The present invention pertains to hydraulic actuators and, more particularly, to a remote-controlled unidirectional linear actuator.

BACKGROUND OF THE INVENTION

Hydraulic actuators typically use external mechanisms to control the relative positioning of the actuator piston and cylinder. These external mechanisms are erratic in operation and often unreliable. While it is desirable to use hydraulic controls because they are smoother in operation, they have the disadvantage of requiring bulky and heavy flow control valves, shut-off valves, etc. Hydraulic controls are generally not feasible in applications where it is desirable to restrict the weight and size of the actuator components.

As an example, reclining seat backs are popular features on patio and deck furniture, such as chaises longues. When using a chaise longue, a user will have his outstretched legs supported by an elongate seat portion and his back supported by the reclining seat back. The typical range of motion of a reclining seat back is between a substantially vertical or upright position and a fully reclined or horizontal position.

In the past, the operation and control of these reclining seat backs has been effected by the user. Typically, the user must provide the force to raise and lower the seat back as the user is reclining on the seat. In addition, the user must set a latching mechanism at one of several preset locations to hold the seat back in a desired position. Although this type of reclining seat back has been suitable for its purposes, it has several disadvantages.

First, the force required for a user to raise and lower the seat back without assistance may be too great when the user is reclining on the seat, especially for the elderly, young children, and the physically impaired. As a result, the user will either require assistance in raising or lowering the seat back or be forced to stand up to move the seat back to the desired position. Second, the latch mechanisms can be difficult to set and release, especially when incorporated into the arm of a chaise longue, because the user must use the arm for support when moving the seat back into the desired position. Finally, these latching mechanisms are limited in the number of preset seat back positions and do not permit adjustment to any desired angle or degree of inclination.

Although mechanized reclining seat backs have been used in automobiles and household furniture, they are not adaptable to patio furniture because of their size, weight, and the need for electric or hydraulic power. Thus, there is a need for a hydraulic actuation and control system that uses an internal hydraulic control valve that can be easily operated with a remotely positioned control device.

SUMMARY OF THE INVENTION

In accordance with the present invention, a unidirectional linear actuator is provided. The actuator comprises a cylinder having a first end and a second end, a piston slidably received within the cylinder to move between the first end and the second end, the piston being resiliently biased in the cylinder to move toward one or the other of the first and second ends, and a rotatable valve mounted on the piston for controlling the movement of the piston in the cylinder to permit selective positioning of the piston at any position between the first and second ends in the cylinder.

In accordance with another aspect of the present invention, the hydraulic control comprises an opening in the piston to permit the flow of hydraulic fluid through the piston as the piston moves in the cylinder, and a rotary valve rotatably mounted on the piston for selectively preventing the flow of hydraulic fluid through the piston.

In accordance with another aspect of the present invention, a reclining seat back actuator and control system is provided. The seat back is pivotally mounted on a seat portion to pivot about a horizontal axis between a substantially upright position and a substantially horizontal reclining position. The system comprises a hydraulic actuator and a hydraulic control system. The actuator has a first end connected to the seat back and a second end connected to the seat portion. The actuator itself comprises a cylinder and a piston slidably received within the cylinder with the piston being resiliently biased in the cylinder to urge the seat back to the substantially upright position. The hydraulic control system stops the movement of the piston in the cylinder to permit selective positioning of the seat back at any position between the upright position and the reclining position.

In accordance with another aspect of the present invention, the hydraulic control system comprises a hydraulic lock for locking the piston in the cylinder and means for operating the hydraulic locking means. Preferably, the hydraulic locking means comprises a rotary valve positioned in the piston for selectively preventing the flow of hydraulic fluid through said piston, and the operating means comprises a cable attached at one end to a handle for imparting linear movement in the cable and at the other end to a position control device that couples the cable to the rotary valve. The position control device is configured to translate linear cable movement into rotational movement to rotate the rotary valve.

In accordance with yet another aspect of the present invention, the hydraulic lock includes a passageway or orifice formed in the piston for metering fluid flow through the piston as the piston moves in the cylinder. The rotary valve may comprise a plug slidably engaged within a chamber formed in a valve body. The valve body is mounted on the piston to rotate about the longitudinal axis of the piston. This permits selective positioning of the plug in alignment over the orifice, such that when the plug is positioned over the orifice the flow of fluid through the orifice is stopped, thereby preventing movement of the piston in the cylinder to hold the seat back in a fixed position.

In accordance with yet a further aspect of the present invention, the plug has two opposed faces and a longitudinal axial bore opening to both faces such that when the plug is positioned over the orifice fluid will flow through the plug and into contact with the inside face of the plug to equalize hydraulic pressure acting on the outside face, thus maintaining a strong seal to prevent fluid flow between the outside face of the plug and the piston.

In accordance with still yet another aspect of the present invention, the position control device includes a follower member attached to the cable and mounted for longitudinal movement within the cylinder and a cam member mounted for rotational movement in the cylinder and attached to the rotatable valve body. The follower member is engaged with the cam member such that longitudinal movement of the follower member causes rotational movement of the cam to thereby rotate the valve body.

As will be readily appreciated from the foregoing description, the present invention provides a linear actuator and control system that allows positioning of the piston in the cylinder at any desired location. The actuator provides a resilient spring force to move the piston and raise an attached seat back automatically when the sitter leans forward and releases the hydraulic lock, eliminating the need for the sitter to physically raise the seat back. The hydraulic fluid flowing through the orifice in the piston is metered to control the rate at which the seat back is raised. In addition, the movement of the seat back to the reclining position is similarly controlled by metering the flow of fluid through the cylinder piston. Furthermore, the equalizing of hydraulic pressure through the plug ensures that the plug is sealed in position and the seat back will not accidentally move out of position. Finally, the linear actuator is compact and light in weight so as to be suitable for use on lightweight patio and deck furniture.

BRIEF DESCRIPTION OF THE DRAWINGS

The foregoing and other features and advantages of the present invention will be more readily appreciated as the same becomes better understood from the detailed description of the invention when considered in conjunction with the following drawings, wherein:

FIG. 5A is an enlarged cross-sectional view of the actuator piston taken along lines 5A showing the hydraulic lock in the locked position;

FIG. 5B is a cross-sectional end view taken along lines 5B of the hydraulic lock of FIG. 5A;

FIG. 6A is an enlarged cross-sectional view taken along lines 6A of the piston and hydraulic lock in the unlocked configuration; and FIG. 6B is a cross-sectional end view taken along lines 6B of the hydraulic lock of FIG. 6A.

DETAILED DESCRIPTION OF THE PREFERRED EMBODIMENT

While the present invention will be described in the context of its application to reclining seat backs for chaises longues, it is to be understood that the unidirectional linear actuator and the hydraulic control valve can be used in other applications as well. For instance, the actuator and control valve can be used with reclining chairs, power seats in vehicles, and other applications where it is desirable to selectively position a hydraulic linear actuator.

Figure 1:
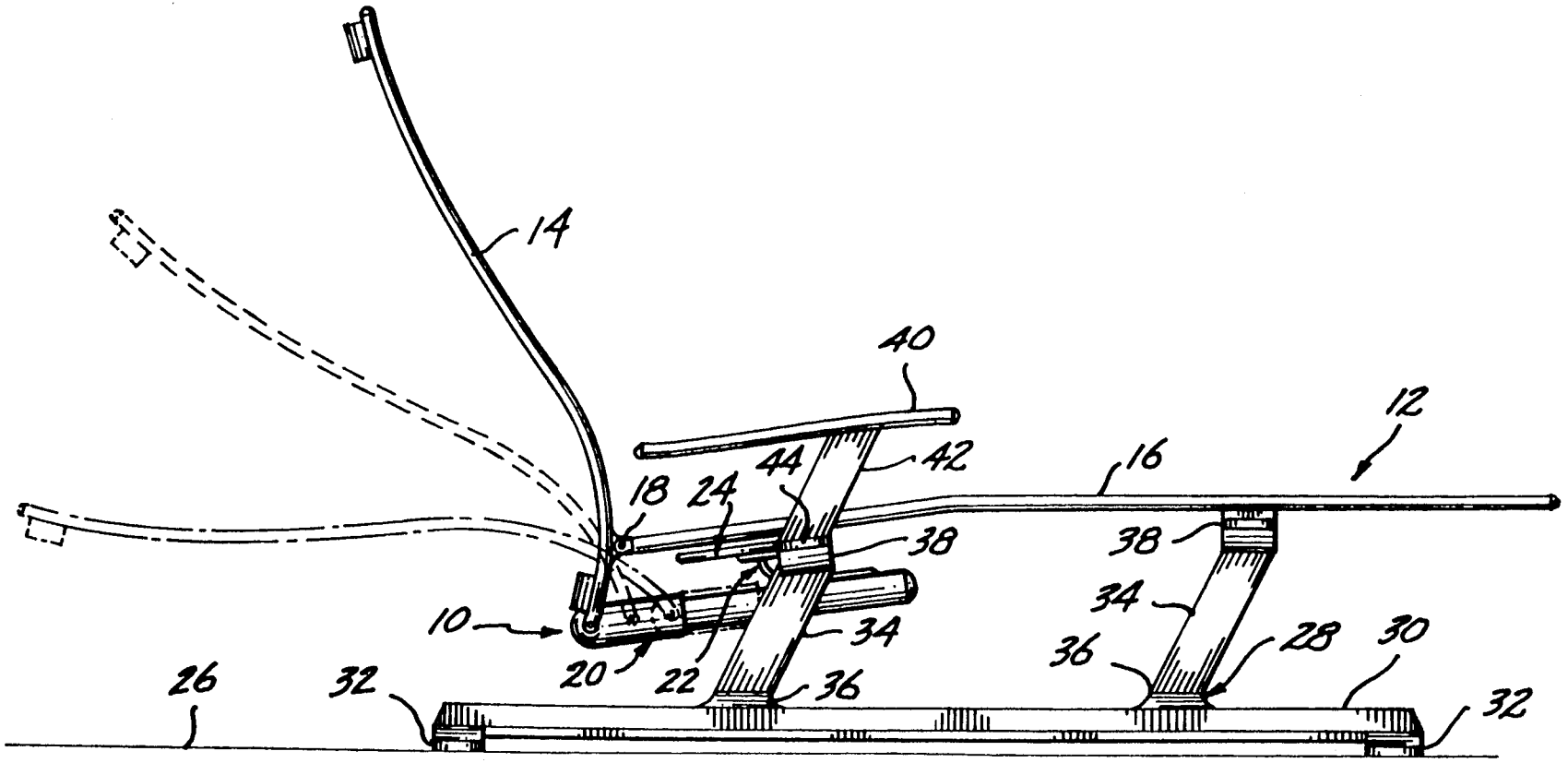
FIG. 1 is a side view of a linear actuator and control system formed in accordance with the present invention as installed on a chaise longue.

A representative embodiment of the reclining seat back actuator and control system 10 is illustrated in FIG. 1 as used on a chaise longue 12. The chaise longue 12 has a seat back 14 that is pivotally mounted on a seat portion 16 by a hinge mechanism 18 to move between a vertically upright position, as shown in solid lines on FIG. 1, and a substantially horizontal reclining position, as shown in phantom lines on FIG. 1. The seat portion 16 is supported above a surface 26 by a frame 28 that includes a longitudinal base 30 having feet 32 mounted at each end thereof and upright supports 34 attached at their lower ends 36 to the base 30 and at their upper ends 38 to the seat portion 16. An arm 40 is supported above each side of the seat portion 16 by a vertical support 42 that is attached at its lower end 44 to the upper end 38 of the upright support 34.

A unidirectional linear actuator 20 is shown having one end connected to the seat back 14 and at the other end connected at a central location to the upright support 34 to control movement of the seat back 14 between the reclining position and the upright position. A control cable 22 is attached at one end to the actuator 20 and connected at the other end to a handle mechanism 24 that is mounted on the seat portion 16.

Figure 2:
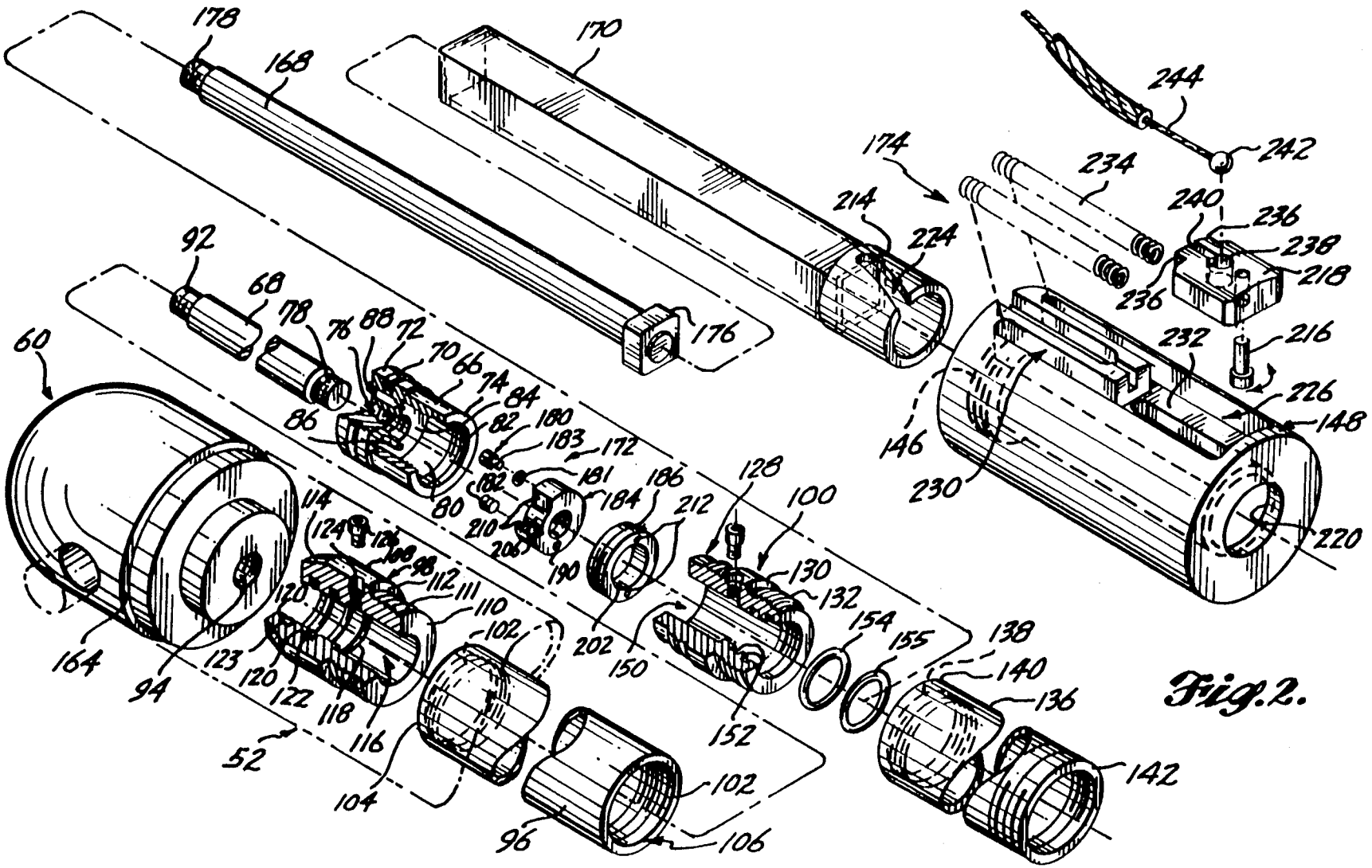
FIG. 2 is an enlarged, exploded view of the actuator of FIG. 1.

The components of the actuator 20 will now be discussed in conjunction with FIGS. 2–4. The actuator 20 includes three general assemblies, a piston assembly 46, a cylinder assembly 48, and a position control assembly 50. These three assemblies are substantially enclosed within an outer housing 52 that is formed in two sections, a first section 54 attached at one end of the cylinder assembly 48 and a second section 56 attached at the other end of the cylinder assembly 48. The first section 54 has an outside diameter that is smaller than the inside diameter of the second section 56 to permit the first section 54 to slide within the second section 56, thus facilitating extension and retraction of the actuator 20. The first section 54 is rotatably mounted to the frame 28 by a mounting screw 57 that extends through a Gimbal 58 positioned centrally on the first section 54 and attached to the upright support 34. A nose cone 60 is attached over the open end of the second section 56 of the outer housing 52 and it is pivotally mounted to the lower edge 62 of the seat back 14 by a pivot pin 64.

The piston assembly 46 comprises a piston 66, a piston rod 68 and an O-ring 70. As best shown in FIG. 2, the piston 66 is formed of a one-piece multi-diameter cylindrical member configured with steps of sequentially decreasing diameter from the left half or first portion 72 and the right half or second portion 74. The outside diameter of the first portion 72 is sized to fit within the cylinder assembly 48. The O-ring 70 is received within a groove 71 formed circumferentially around the center of the first portion 72 to hydraulically seal the piston 66 as it slides within the cylinder assembly 48. A threaded internal axial bore 76 is formed in the first section 72 to engage a threaded end 78 on the piston rod 68.

The second portion 74 of the piston 66 has a smaller outside diameter than the first portion 72. A large-diameter internal axial bore 80 is formed within the second portion 74 that communicates with the axial bore 76 in the first portion 72. Internal threads 82 are formed at the opening and continue halfway down the large diameter bore 80. The balance of the bore 80 is unthreaded and terminates at a shoulder 84. Extending longitudinally from the shoulder 84 into the large diameter bore 80 is a small cylindrical projection 86 that projects approximately one-fourth the length of the bore 80. Extending through the first portion 72 is an orifice or passageway 88 of generally cylindrical shape that necks down to a smaller diameter section 90 where it communicates with the large diameter bore 80. This passageway 88 is coaxial with the threaded bore 76 in the first portion 72.

As described above, the piston rod 68 has a first threaded end 78 that engages the threaded internal bore 76 on the piston 66. At the other end of the piston rod 68 is a second threaded end 92 that is received within a threaded axial bore 94 in the nose cone 60. When assembled, the piston 66, piston rod 68 and nose cone 60 move together as a unit with respect to the cylinder assembly 48.

The cylinder assembly 48 comprises a cylinder 96, a first cylinder end fitting 98, and a second cylinder end fitting 100. The cylinder 96 is formed from an elongate tube having internal threads 102 at its first open end 104 and its second open end 106. The first cylinder end fitting 98 includes a first section 108 and a second section 110. The second section 110 has external threads 111 that engage the internal threads 102 at the first open end 104 in the cylinder 96. The first section 108 has an outside diameter larger than the second section 110 such that a shoulder 112 is formed. The exterior of the first section 108 has a smooth finish with a beveled outside edge 114. An internal axial bore 116 is formed through the first end fitting 98 with the inside diameter in the first section 108 being smaller than the inside diameter in the second section 110 such that an internal shoulder 118 is formed. The portion of the internal bore 116 and in second section 110 has a smooth finish while the portion of the bore 116 in the first section 108 has two concentric internal grooves 120 in which are received two O-rings 122 and 123. The inner O-ring 122 is a hydraulic seal, and the outer O-ring 123 is used as a wiper ring on the piston rod 68. A threaded passageway 124 is radially formed through the first section 108 of the first end fitting 98 to communicate with the internal bore 116 for use as a fill hole for hydraulic fluid. A small bolt 126 is threaded in the passageway 124 to close off the fill hole.

The second cylinder end fitting 100 has a first end section 128, a middle section 130 and a second end section 132, all integrally formed. The middle section 130 has an outside diameter greater than the outside diameter of the first and second end sections 128 and 132 such that an external shoulder 134 is formed on each side of the middle section 130. The exteriors of the first and second end sections 128 and 132 are threaded. The first end section is threadably engaged with the internal threads 102 on the second opening 106 on the cylinder 96. The second end section 132 is threaded to engage the first end 140 of a cylinder extension 136. The cylinder extension 136 has a second end 142 that attaches to an actuator barrel 148, as will be described more fully below. A fill hole 144 is formed in the middle section that is closed with a bolt 146. An internal axial bore 150 is formed through the second end fitting 100, with the portion of the bore 150 in the second end section 132 having a pair of coaxial internal grooves 52 in which are received O-rings 154 and 155, which function in the same manner as the previously described O-rings 122 and 123.

Figure 3:
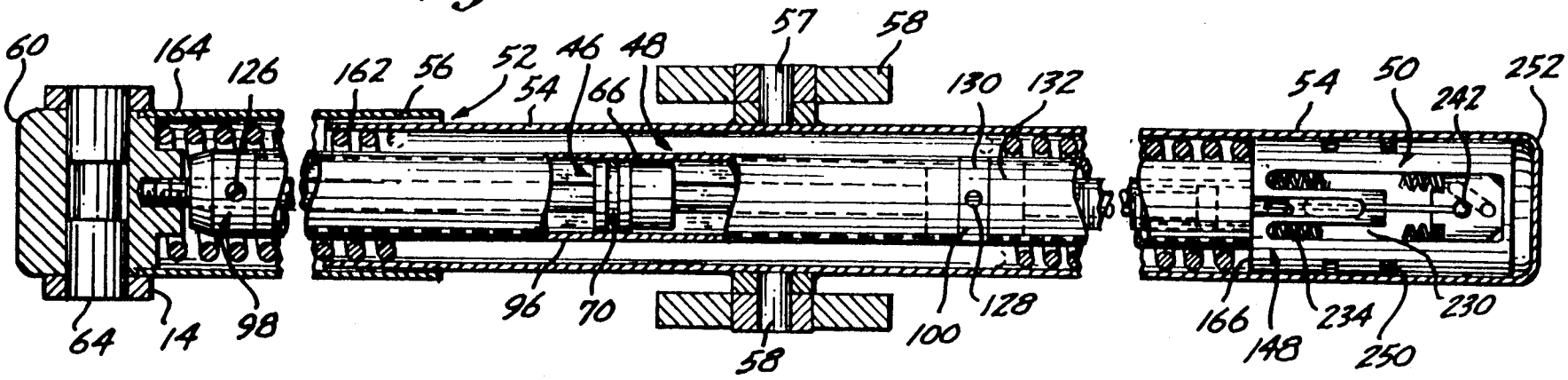
FIG. 3 is a cross-sectional top view of the assembled actuator formed in accordance with the present invention.
Figure 4:
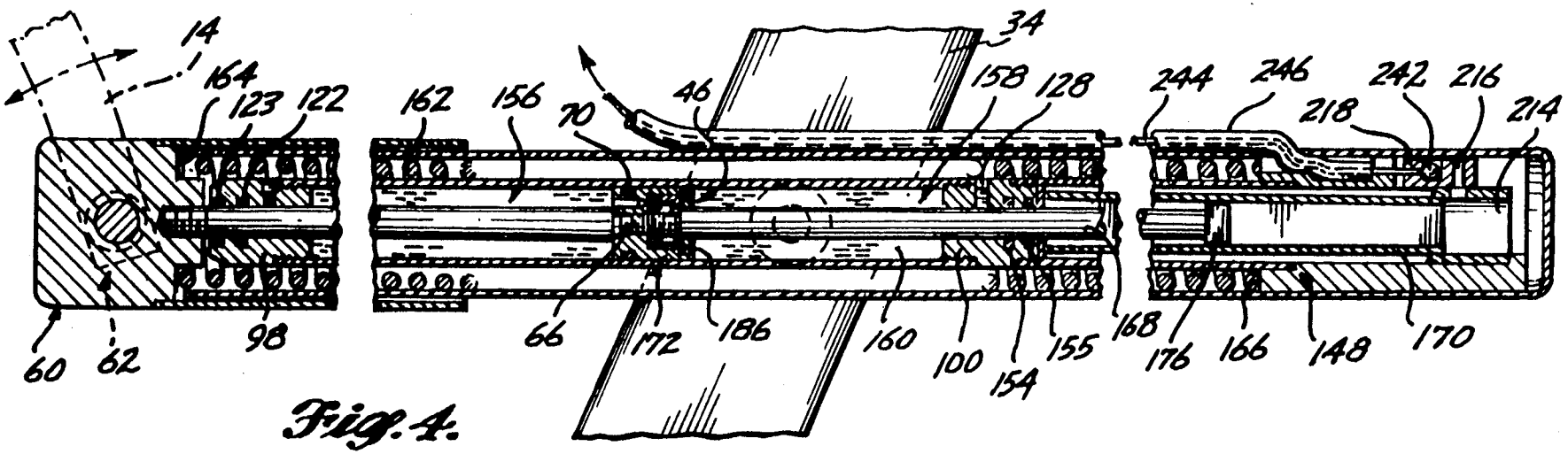
FIG. 4 is a cross-sectional side view of the actuator of FIG. 3.

When the piston assembly 46 is assembled and placed within the cylinder assembly 48, as shown in FIGS. 3 and 4, a first hydraulic chamber 156 will be formed between the first cylinder end fitting 98 and the piston 66 and a second hydraulic chamber 158 will be formed between the piston 66 and the second cylinder end fitting 100. Movement of the piston 66 to the left in the cylinder 96 is effected by a large helical compression spring 162 placed around the exterior of the cylinder 96 and having one end bearing against a shoulder 164 formed on the nose cone 60 and the other end bearing on a shoulder 166 formed on the actuator barrel 148. The rate of movement of the piston 66 is controlled by metering the flow of hydraulic fluid 160 through the passageway 88 in the piston 66. Movement of the piston 66 is stopped or prevented by hydraulically locking the piston 66 in position in the cylinder 96 by means of the position control assembly 50.

Referring back to FIG. 2, the position control assembly 50 includes a shaft 168 slidably received within tube 170 having a square-shaped cross-sectional configuration, a rotatable valve assembly 172 attached to the shaft 168, and a cam assembly 174 mounted within the actuator barrel 148 for rotating the tube 170, the shaft 168, and the valve assembly 172.

The shaft 168 has a square-shaped fitting 176 on one end that is sized and shaped to be slidably received within the square-shaped tube 170. As such, this arrangement permits the shaft to slide in the tube 170 longitudinally but to remain in positive engagement with the tube 170 as the tube 170 is rotated about its longitudinal axis. The other end of the shaft 168 has a threaded spindle 178 that engages the cam assembly 174.

The valve assembly 172, shown more clearly in FIGS. 5A–6B, includes a stopper or plug 180 slidably receivable within a rotatable valve body 184, a smooth-faced adjusting bolt 182 in the valve body 184, and a retaining ring 186. The valve body 184 has a threaded internal axial bore 188 that engages the threaded spindle 178 on the shaft 168. A first cylindrical opening 190 is formed through the valve body 184 and is sized and threaded to receive the bolt 182. The bolt 182 projects out of the valve body 184 and bears against the shoulder 84 to space the valve body 184 away from the shoulder 84 in the piston 66. Positioned 180° from the first cylindrical opening 190 is a second cylindrical opening 192 with an internal diameter that steps down to a smaller diameter to form an internal shoulder 194. The plug 180 has a stepped-down external diameter forming an external shoulder 183. The plug 180 is sized and shaped to be slidably received within the second cylindrical opening 192 in the valve body 184. A compressible O-ring 181 is placed over the smaller diameter portion of the plug 180 to have one face bear against the plug shoulder 183. When the plug 180 is inserted into the second opening 192, the other face of the O-ring 181 bears against the shoulder 194. An internal bore 196 is formed through the plug 180 that opens to both an inside face 198 and an outside face 200 on the plug 180.

The retaining ring 186 has a smooth internal bore 202 sized to slide over the shaft 168 and have clearance between the shaft 168 and the bore 202 to permit the flow of hydraulic fluid between the ring 186 and the shaft 168. The ring 186 has external threads to engage the internal threads 82 in the second portion 74 on the piston 66. To assemble, the retaining ring 186 is slid over the shaft 168 and the rotatable valve body 184 is threaded onto the threaded spindle 178 such that the bolt 182 and the plug 180 are facing away from the shaft 168. The valve assembly 172 is then inserted within the large-diameter internal bore 80 of the piston 66 and the retaining ring 186 is threaded into the second portion 74 of the piston 66 and tightened until the bolt 182 and plug 180 are in positive contact with the piston 66. The retaining ring 186 has two passageways 212 formed therein to facilitate tightening with a spanner wrench. The O-ring 181 will partially compress to resiliently bias the plug 180 into contact with the shoulder 84 in the piston 66. The bolt 182 is preadjusted prior to assembly to achieve the desired compression of the O-ring 181.

The rotatable valve body 184 has a longitudinal channel 206 formed in the external face 208 into which the small cylindrical projection 86 extends. When the valve body 184 rotates clockwise within the piston 66, as shown in FIG. 5A, the face 210 of the channel 206 contacts the projection 86 to limit rotation of the cam assembly 174 so that the plug 180 is aligned with the passageway 88. When the plug 180 is rotated into alignment with the passageway 88, hydraulic fluid will flow from the passageway 88 and through the internal bore 196 in the plug 180 to equalize hydraulic pressure acting on the outside face 200 and help in forcing the plug 180 against the shoulder 84 of the piston 66 to prevent hydraulic fluid from flowing between the outside face 200 of the plug 180 and the shoulder 84.

Rotation of the rotatable valve assembly 172, the shaft 168, and the square-shaped tube 170 is effected by the cam assembly 174. The cam assembly 174, shown more clearly in FIG. 2, includes a cylindrical cam member 214 welded to one end of the square-shaped tube 170, and a cam follower 216 held in a cam holder 218 that is slidably received on the actuator barrel 148. The actuator barrel 148 is cylindrically shaped having an internal axial bore 220. A larger diameter threaded portion 146 is formed at one end of the internal axial bore 220 into which the cylinder extension 136 is threaded, as previously described. A recess 226 is formed in the exterior surface of the actuator barrel 148 in which the cam holder 218 is slidably received. The recess 226 has a central area 232 from which two parallel legs 230 project. An opening 228 is formed in the bottom of the central area 232 of the recess 226 that communicates with the internal axial bore 220. The actuator barrel 148 is press-fit into the second section 56 of the outer housing 52 and retained in place with forced cap screws 250 projecting through the second section 56 and into the actuator barrel 148. A barrel cap 252 is press-fit over the end of the second section 56 of the outer housing 52.

The cam member 214 is formed of a cylindrical tube having a wall 222 with an elongate opening 224 formed therein. The cam member 214 is slidably received within the internal axial bore 220 of the actuator barrel 148 so that the elongate opening 224 is aligned with the elongate longitudinal opening 228 in the recess 226.

The cam holder 218 is sized and shaped to be slidably received within the central area 232 of the recess 226. The cam follower 216 projects down from the cam holder 218 and through the opening 228 to project into the elongate opening 224 in the cam member 214. Two springs 234 are placed within the recessed legs 230, each having one end that bears against shoulders 236 formed on the cam holder 218 to urge the cam holder 218 to slide to one end of the central area 232.

A cylindrical opening 238 and channel 240 that communicate with each other are formed in the cam holder 218. A spherical fitting 242 on the end of a cable 244 is sized to be received within the cylindrical opening 238. As shown more clearly in FIG. 4, the second section 56 of the outer housing 52 has an access opening 248 into which the cable 244 and sheath 246 are inserted. The end of the cable 244 having the spherical fitting 242 is fit into the cylindrical opening 238 in the cam holder 218. The other end of the cable 244 is connected to the handle mechanism 224 on the seat portion 16. Movement of the handle mechanism 24 causes linear movement of the cable 244 which in turn causes the cam holder 218 to slide back and forth in the central recess area 232. This results in linear movement of the cam follower 216 within the elongate opening 224 to cause rotation of the cam member 214 and the attached square-shaped tube 170. This in turn rotates the shaft 168 and the rotatable valve assembly 172.

In operation, a user reclining on the chaise longue 12 with the seat back 14 initially in the upright position will control operation of the linear actuator 20 through the handle mechanism 24. By grasping the handle 24 and pulling it outward away from the seat portion 16, the user imparts linear movement to the cable 244. As previously described, linear movement of the cable 244 is translated into rotational movement of the rotatable valve assembly 172 through the cam assembly 174. As shown more clearly in FIGS. 5B and 6B, when the cable 244 is actuated, the cam assembly 174 rotates the rotatable valve assembly 172 in a counterclockwise direction to unstop the passageway 188. Hydraulic fluid 160 will flow through the passageway 88, through the clearance space between the valve body 184 and the shoulder 84, through the longitudinal channel 206 in the valve body 184 and between the clearance space provided between the retaining ring 186 and the piston shaft 168. At this point, force exerted by the user against the seat back 14 moves the piston from the left to the right in the cylinder 96, causing the seat back 14 to pivot about the hinge mechanism 18 and move to the reclining position. Movement of the seat back 14 may be stopped at any position by the user returning the handle mechanism 24 to the original position. This movement causes the cam assembly 174 to rotate the rotatable valve assembly 172 in a clockwise direction until the face 210 in the longitudinal channel 206 contacts the small cylindrical projection 86. At this point the plug 180 will be aligned with the passageway 88 to prevent further fluid flow and hydraulically lock the piston 66 in position in the cylinder 96.

Movement of the seat back 14 from the reclining position to the upright position is effected by the large helical compression spring 162. The force stored in the compressed spring 162 is released by the user moving the handle mechanism 24 to unlock the piston 66 and then leaning forward to reduce resistance against the force of the spring 162. The seat back 14 will then move to the upright position in a controlled manner due to the metering of the flow of hydraulic fluid through the passageway 88 in the piston 66.

Although a preferred embodiment of the invention has been illustrated and described, it will be appreciated that various changes may be made therein without departing from the spirit and scope of the invention. For instance, while most of the components may be formed of aluminum alloy, injection-molded or composite plastic may be substituted for many of the parts. Furthermore, the square-shaped tube 170 may be hexagonal or octagonal, as will be the matching nut 176 that is slidably received therein.

The embodiments of the invention in which an exclusive property or privilege is claimed are defined as follows:

1. An actuator and control system for a reclining seat back, the seat back being pivotally mounted on a seat portion to pivot about a horizontal axis between a substantially upright position and a substantially horizontal reclining position, the system comprising:

(a) an actuator having a first end connected to the seat back and a second end connected to the seat portion, said actuator having a cylinder and a piston slidably received within said cylinder, said piston being resiliently biased in said cylinder to urge the seat back to the upright position; and (b) means for hydraulically controlling the movement of said piston in said cylinder to permit selective positioning of the seat back at any position between the upright position and the reclining position, the hydraulic control means including means for hydraulically locking said piston in said cylinder and means for operating said hydraulic locking means, the hydraulic locking means including a rotary valve positioned within said piston for selectively preventing the flow of hydraulic fluid through said piston, the operating means including a cable attached at one end to means for imparting linear movement to said cable and at the other end to a position control means that couples said cable to said rotary valve, said position control means being configured to translate linear cable movement into rotational movement to rotate said rotary valve.

2. The system of claim 1, wherein said position control means further comprises a follower means attached to said cable and mounted for longitudinal movement within said cylinder and a cam means mounted for rotational movement in said cylinder and attached to said rotatable cylinder body, said cam means engaged with said follower means such that longitudinal movement of said follower means causes rotational movement of said cam means to thereby rotate said cylinder body.

3. The system of claim 2, wherein said actuator further comprises means for resiliently urging said piston to extend from said cylinder, said means comprising a helical compression spring mounted on said linear actuator to urge said piston to move in said cylinder.

4. In a piece of furniture having a seat portion and a seat back portion hinged to the seat portion to pivot between an upright position and a reclining position, a reclining seat back actuator and control system comprising:

(a) a linear actuator having one end connected to the seat back portion and the other end connected to the seat portion, said linear actuator having a piston slidably received within a closed cylinder and means for resiliently urging said piston to extend from said cylinder to move the actuator ends apart, thereby pivoting the seat back portion from the reclining position to the upright position;

(b) a hydraulic lock for preventing movement of said piston in said cylinder to thereby hold the seat back portion at a selected position, the hydraulic lock including an orifice formed in said piston for metering fluid flow through said piston as said piston moves in said cylinder and means for stopping the flow of fluid through said orifice, the stopping means including a stop member slidably engaged within a chamber formed on a cylinder body, said cylinder body rotatably mounted on said piston to selectively position said stop member in alignment over said orifice such that when said stop member is positioned in alignment over said orifice the flow of fluid through said orifice is stopped, thereby preventing movement of said piston in said cylinder and holding the seat back portion in a fixed position, the stop member having two opposed faces and a longitudinal axial bore opening to both faces such that when said stop member is positioned over said orifice, fluid will flow through said orifice and through said stop member to equalize hydraulic pressure on said stop member; and (c) means for controlling said hydraulic lock to permit selective positioning of the seat back portion, the control means including a cable attached at one end to said linear actuator and at the other end to means for imparting linear movement to said cable, said control means further comprising means for translating the linear cable movement into rotational movement to rotate said rotatable cylinder body.

5. The system of claim 4, wherein said translating means comprises a follower means attached to said cable and mounted for longitudinal movement within said cylinder and a cam means mounted for rotational movement in said cylinder and attached to said rotatable cylinder body, said cam means engaged with said follower means such that longitudinal movement of said follower means causes rotational movement of said cam means to thereby rotate said cylinder body.

6. The system of claim 5, wherein said means for resiliently urging said piston to extend from said cylinder comprises a helical compression spring mounted on said linear actuator to urge said piston to move in said cylinder.

7. An actuator and control system for a reclining seat back, the reclining seat back being pivotally hinged at one end to a seat portion for movement between a reclining position and an upright position, the actuator comprising:

(a) a piston assembly slidably received in a cylinder for longitudinal movement between a retracted position, wherein said piston assembly is inserted within said cylinder, and an extended position, wherein said piston assembly extends from said cylinder, said piston assembly being connected to either of the seat back or the seat portion, said cylinder assembly being connected to the other of the seat back or the seat portion, said piston assembly being resiliently biased by a helical compression spring to move to the extended position to thereby move the seat back to the upright position;

(b) a hydraulic lock for preventing longitudinal movement of said piston assembly in said cylinder to thereby hold the seat back at a fixed position, said hydraulic lock comprising a passageway formed in said piston assembly for metering hydraulic fluid flow through said piston assembly to permit said piston assembly to move to the extended position in response to force exerted by said helical compression spring and to permit said piston assembly to move to the retracted position as said helical compression spring is compressed, and a rotatable valve assembly mounted on said piston assembly to selectively stop the flow of hydraulic fluid through said piston assembly; and (c) a control assembly for controlling said hydraulic lock to permit selective positioning of the seat back at any position between the reclining position and the upright position, the control assembly comprising a cable attached at one end to a handle means remotely positioned from the hydraulic lock adjacent the seat portion, the handle means adapted to impart linear movement to said cable and at the other end to a coupling assembly to couple said cable to said hydraulic lock, said coupling assembly being configured to translate the linear cable movement into rotational movement to thereby rotate said rotatable valve assembly.

8. The system of claim 7, wherein said coupling assembly comprises a cylinder having a wall and an internal axial bore, an elongate shaft having one end attached to said rotatable stop member on said piston and the other end slidably received in said internal axial bore of said cylinder, and a cam means coupling said cylinder to said cable such that longitudinal movement of said cable rotates said cylinder to thereby rotate said shaft and said valve assembly.

9. The system of claim 8, wherein said rotatable valve assembly comprises a plug slidably received within a rotatable valve body, said rotatable valve body being rotatably mounted on said piston to rotate about the longitudinal axis of said piston and move said plug into alignment with said passageway to stop the flow of hydraulic fluid through said piston assembly.

10. The system of claim 9, wherein said plug has an outer face that bears against said piston and an inner face received within said rotatable valve body, and a longitudinal axis bore opening to both of said faces to permit hydraulic fluid to flow therethrough when said plug is aligned over said passageway such that hydraulic pressure is equalized within said plug to prevent the outer face of said plug from being forced away from said piston by hydraulic pressure.

* * * * *